US006625289B1

(12) United States Patent
Oliemuller

(10) Patent No.: US 6,625,289 B1
(45) Date of Patent: Sep. 23, 2003

(54) STEREO LOUDSPEAKER SYSTEM

(75) Inventor: Robert J. Oliemuller, Krommenie (NL)

(73) Assignee: Triple W Trading B.V., Uffelte (NL)

( * ) Notice: Subject to any disclaimer, the term of this patent is extended or adjusted under 35 U.S.C. 154(b) by 0 days.

(21) Appl. No.: 09/077,428

(22) PCT Filed: Sep. 25, 1996

(86) PCT No.: PCT/NL96/00373

§ 371 (c)(1),
(2), (4) Date: Nov. 5, 1998

(87) PCT Pub. No.: WO97/20450

PCT Pub. Date: Jun. 5, 1997

(30) Foreign Application Priority Data

Nov. 29, 1995 (NL) ..... 1001771

(51) Int. Cl.[7] ..... H04R 25/00

(52) U.S. Cl. ..... 381/182; 381/345; 381/349; 181/145

(58) Field of Search ..... 381/182, 186, 381/345, 349, 300, 335, 386, 302, 305; 181/144, 145, 147

(56) References Cited

U.S. PATENT DOCUMENTS 2,491,982 A * 12/1949 Kincart
3,065,816 A * 11/1962 Ranger
3,104,729 A * 9/1963 Olson ..... 181/31
3,666,041 A * 5/1972 Engelhardt
3,670,842 A * 6/1972 Ekdahl et al.
3,933,219 A 1/1976 Butler
4,146,744 A * 3/1979 Veranth
4,179,585 A 12/1979 Herrenschmidt
4,201,274 A * 5/1980 Carlton
4,256,922 A 3/1981 Gorike
4,284,166 A * 8/1981 Gale
4,503,903 A 3/1985 McDowell
4,875,546 A * 10/1989 Krnan
5,117,459 A 5/1992 McShane
5,216,209 A 6/1993 Holdaway
5,227,591 A 7/1993 Tarkkonen
5,485,521 A * 1/1996 Yagisawa et al. ..... 181/160
5,936,209 A * 8/1999 Alton, Jr.

* cited by examiner

*Primary Examiner*—Duc Nguyen
(74) *Attorney, Agent, or Firm*—Jeffrey D. Myers

(57) ABSTRACT

A stereo loudspeaker system (1) consists of a unitary enclosure (2), the rear wall (3) of which is oriented towards a reflecting wall (13), said enclosure (2) including an even number of low-frequency loudspeakers (15) which are disposed symmetrically in the rear wall (3) at an angle to each other. In addition to the low-frequency loudspeakers, the system includes a number of the loudspeakers (16, 17) which are all housed in the same enclosure (2) and are disposed approximately in the same loudspeaker plane or, at least some of them, in pairs at equal distances therefrom. The reflecting wall (13) can consist of a wall of a listening room or of a reflector belonging to the stereo loudspeaker system and connected to said enclosure.

10 Claims, 4 Drawing Sheets

STEREO LOUDSPEAKER SYSTEM

Figure 1:
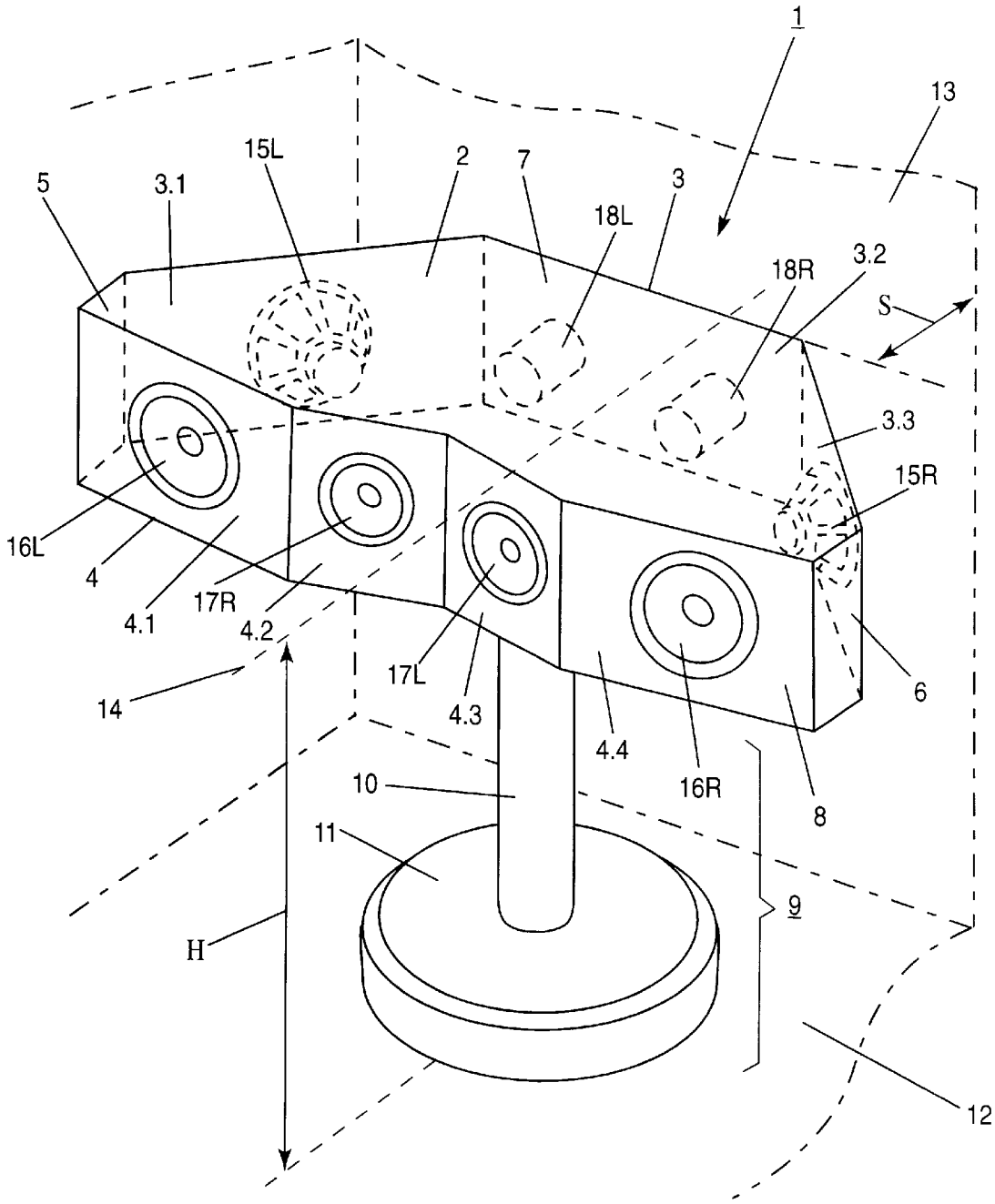

The present invention relates to a stereo loudspeaker system comprising a unitary enclosure having a rear wall intended to be oriented towards a reflecting wall, a front wall positioned opposite thereof, side walls, a top wall and a bottom wall, said stereo loudspeaker system including an even number of low-frequency loudspeakers (woofers) which are disposed symmetrically in the rear wall at an angle to each other.

The combination of an enclosure with a number of loudspeakers and possibly some electronic components such as a separating filter present in that enclosure, is in general referred to as a speaker box. This expression or the expression "box", in the above meaning, will also be used in the remainder of this description. Known stereo loudspeaker systems in general comprise at least two speaker boxes which are spaced from each other, and which, each include, in many cases, several loudspeakers, each of which operates over a part of the acoustic frequency spectrum between approximately 10 Hz. and 20,000 Hz. Many loudspeaker systems even comprise pure than two speaker boxes is order to make the stereo impression as perfect as possible. The function of speaker boxes is to produce sound, which implies that in fact the speaker box preferably should not take up any space at all. In practice, speaker boxes of course always have a certain volume, and in fact, a relatively large volume is more advantageous than a relatively small volume for a good sound reproduction and a good stereo impression.

A particularity of the perception of the stereo impression of a sound installation, is that the human ear is relatively insensistive to the precise location of the low-frequency loudspeakers or woofers. This offers the possibility to position one or more woofers in a central speaker box, so that the loudspeakers reproducing the midrange sounds (squawkers) and those reproducing the high-frequency sounds (tweeters) can be positioned, together or separately, in separate speaker boxes for the left and right stereo channel, each of which requires a much smaller volume than when these would include a woofer as well. Accordingly, stereo installations are known comprising a unitary enclosure, the rear wall of which incorporates two woofers which are oriented towards the wall of a listening room. Hence, this type of stereo loudspeaker systems thus requires at least three speaker boxes: a central speaker box including woofers and at least two other speaker boxes for the left and the right stereo channel, respectively.

The invention aims to provide a stereo installation system of the type mentioned is the preamble, which takes up less space than comparable known stereo installations and which allows more freedom with respect to the positioning of the stereo loudspeaker system. To this end, the invention is characterized in that, in addition to the even number of symmetrically arranged woofers, the system includes an even number of other loudspeakers which are all located in said unitary enclosure, and in that the loudspeakers are arranged approximately next to each other in a single loudspeaker plane or, at least some of them, in pairs at equal distances from said loudspeaker plane.

The stereo loudspeaker system according to the invention thus merely comprises a single, unitary enclosure which includes all the necessary loudspeakers in the above mentioned arrangement. It has been found that in this way an excellent stereo impression can be obtained by means of only one speaker box.

It is known to use stereo speaker boxes comprising so-called bass reflex pipes in order to improve the reproduction of low-frequency sounds. An embodiment of the invention comprising bass reflex pipes is characterized in that an even number of symmetrically arranged bass reflex pipes arc disposed in the rear wall between the woofers, and in that the bass reflex pipes are located in said loudspeaker plane, or at least some of them in paris at equal distances from said loudspeaker plane.

In practice, this arrangement has been found to be important for achieving a good low-frequency sound reproduction in the stereo loudspeaker system according to the invention, which can moreover be further improved in this respect using the following embodiment, which is characterized in that the angle between the woofers is within the range of 55 to 70 degrees, and is preferably about 62 degrees. It has been found that, as a result of the inclined disposition of the woofers at the above-mentioned angle, an optimum distribution of low-frequency sound reproduction is obtained.

For the reproduction of the part of the acoustic frequency spectrum above the low-frequency range, a further embodiment of the invention is important in which suitable frequency filters may be used and which is characterized in that one half of the loudspeakers present can be connected to the left stereo channel aid the other half can be connected to the right stereo channel of a stereo amplifier. in that a midranqe loudspeaker (squawker) that can be connected to the left stereo channel, and a high-frequency loudspeaker (tweeter) that can be connected to the left stereo channel, as well as a squawker that can be connected to the right stereo channel, and a tweeter that can be connected to the right stereo channel, are disposed in the front wall of the enclosure, in that the two tweeters are disposed between the two squawkers, in that the tweeter for the right stereo channel is disposed between the squawker for the left stereo channel and the tweeter for the left stereo channel, and in that the tweeter for the left stereo channel is disposed between the squawker for the right stereo channel and the tweeter for the right stereo channel.

This special arrangement of squawkers and tweeters has been found important for obtaining a good and satisfying stereo impression. Moreover, it had been found that the positioning of the loudspeaker system and the position of the listener in a listening room with respect to the loudspeaker system are less critical with this arrangement.

A further improvement of the above embodiment can be obtained by means of yet another embodiment, which is characterized in that the squawkers are disposed in front wall panels which are oriented at an angle to each other, and in that each of the tweeters is disposed in a front wall panel which is, at least approximately, parallel to the front wall panel in which the squawker of the corresponding stereo channel is disposed.

In order to use the volume in the unitary enclosure as well as possible, another embodiment of the invention is important, which is characterized in that the acoustic space enclosed in the enclosure is at least shared by the woofers, and in that one or more conductors made of a rigid material are located within the acoustic space for the purpose of bass reflection.

The squawkers and tweeters are usually provided with airtight envelopes at the rear side thereof so that, in acoustic respect, they are not located within the same space as the woofers. As the airtight envelopes are relatively thin, the greater part of the volume enclosed in the enclosure is available as acoustic space to the woofers and any bass reflex pipes present. By a correct positioning of one or more conductors, the volume present can be used optimally so as to achieve the best possible reproduction by the woofers themselves and by the bass reflex pipes.

In many cases, the reflecting walls behind the box consist of suitable rigid or at least advantageously reflecting walls of a listening room, such as a living room or the like. It is also possible to use an embodiment of the invention which is characterized in that the reflecting wall consists of a reflector which is connected to the enclosure. Consequently, the box is not dependent on the reflecting properties of the wall of a listening room.

It has been found in practice that the positioning of the box relative to the wall is quite critical for obtaining a good sound quality. An embodiment of a box having a rear wall in the form of a reflector has some advantages in this respect and is characterized in that the reflector is mounted at a predetermined optimum distance from the enclosure which is determined on the basis of sound quality criteria. Preferably, yet another embodiment is used, which is characterized in that the reflector is connected to the enclosure in an inseparable fashion. As a result, the optimum positioning of the reflector relative to the rear wall of the box is continuously assured.

Figure 2:
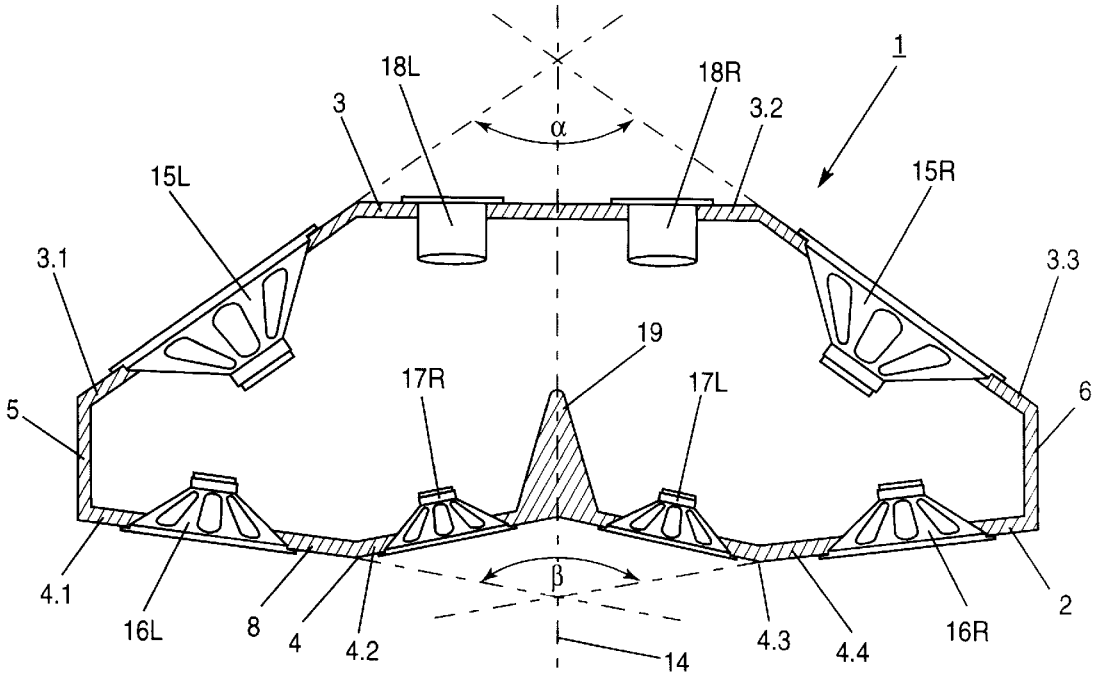
Figure 3:
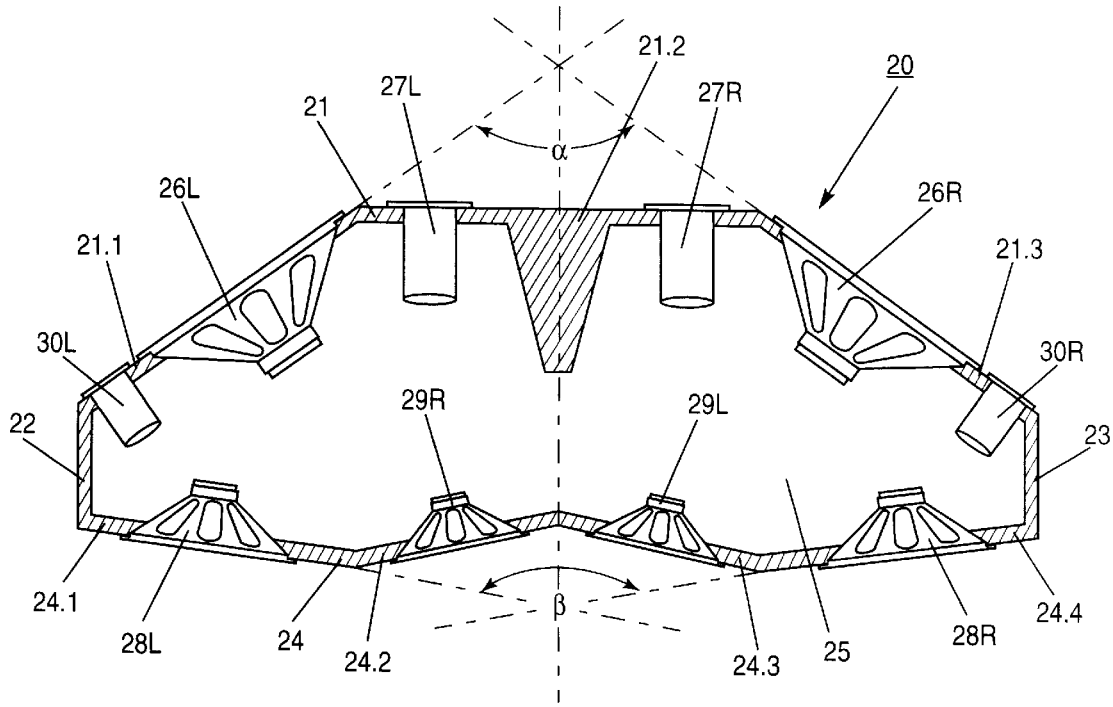
Figure 4:
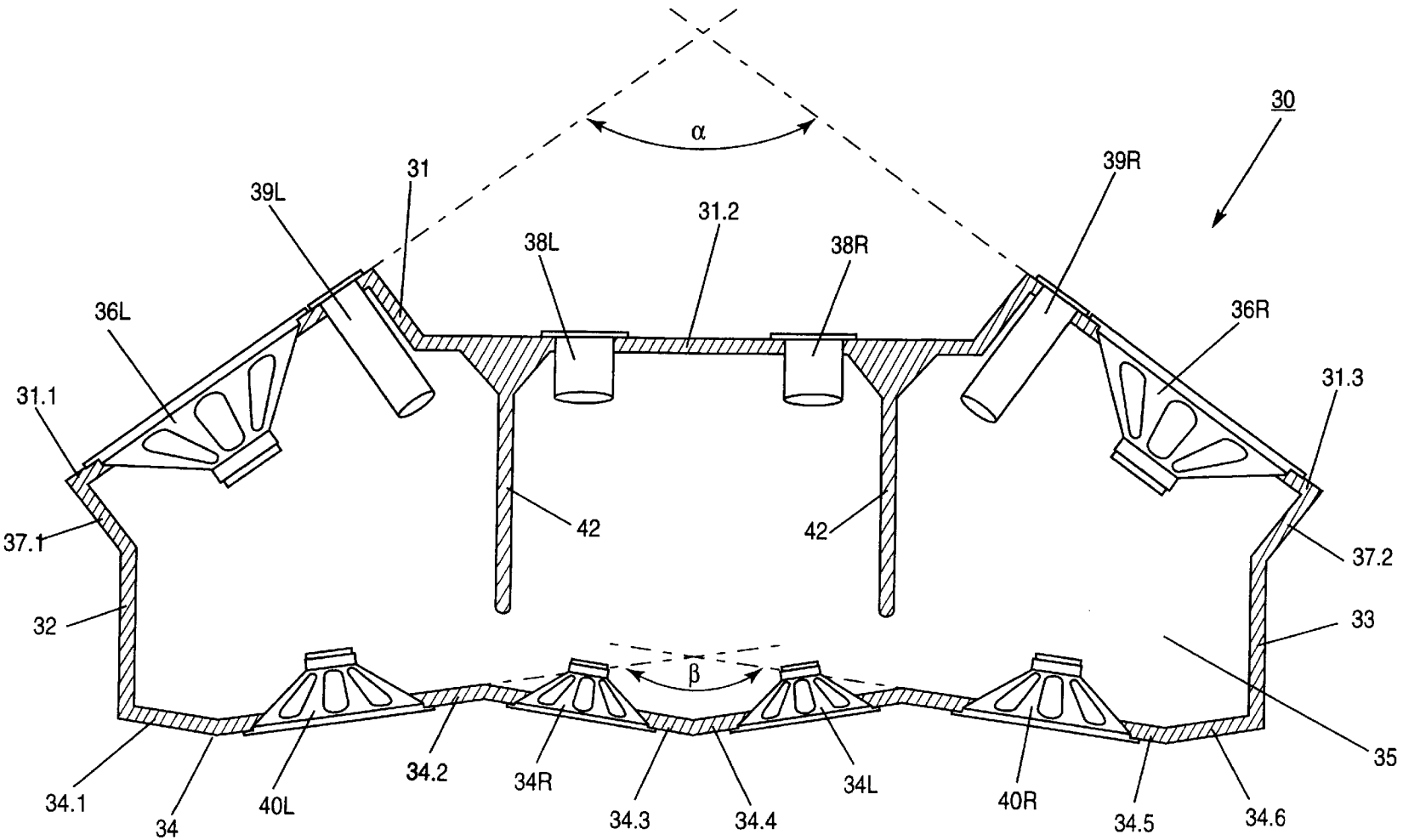
Figure 5:
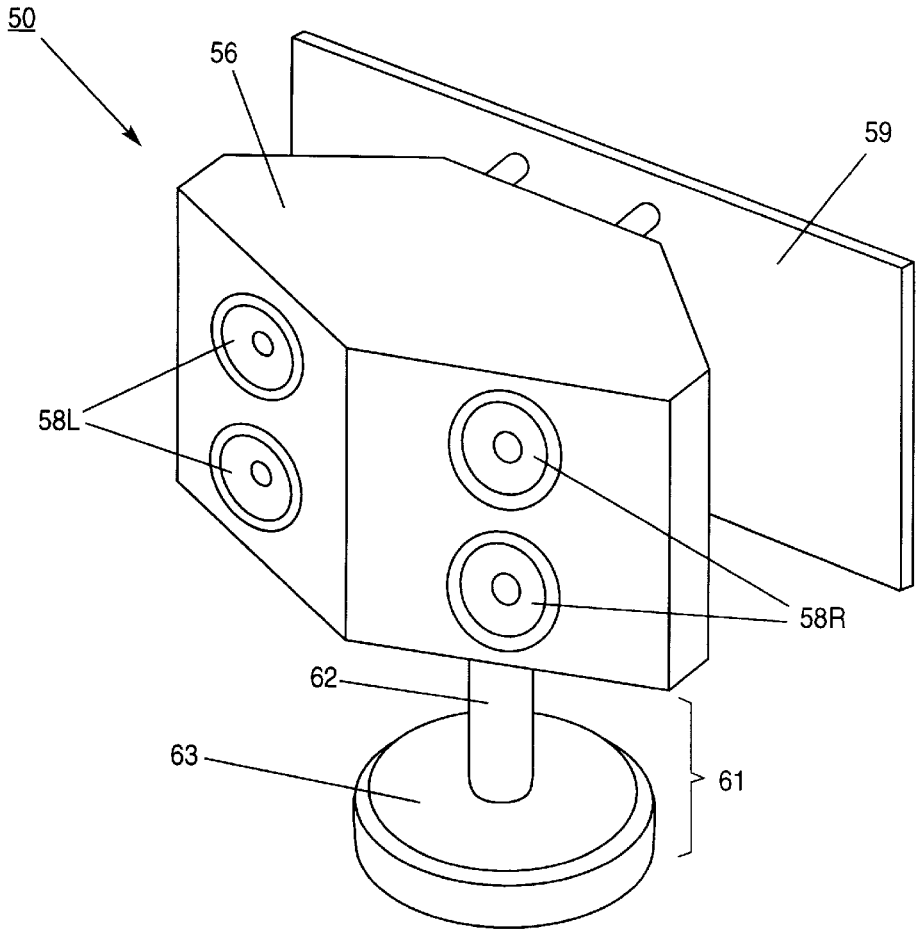
Figure 6:
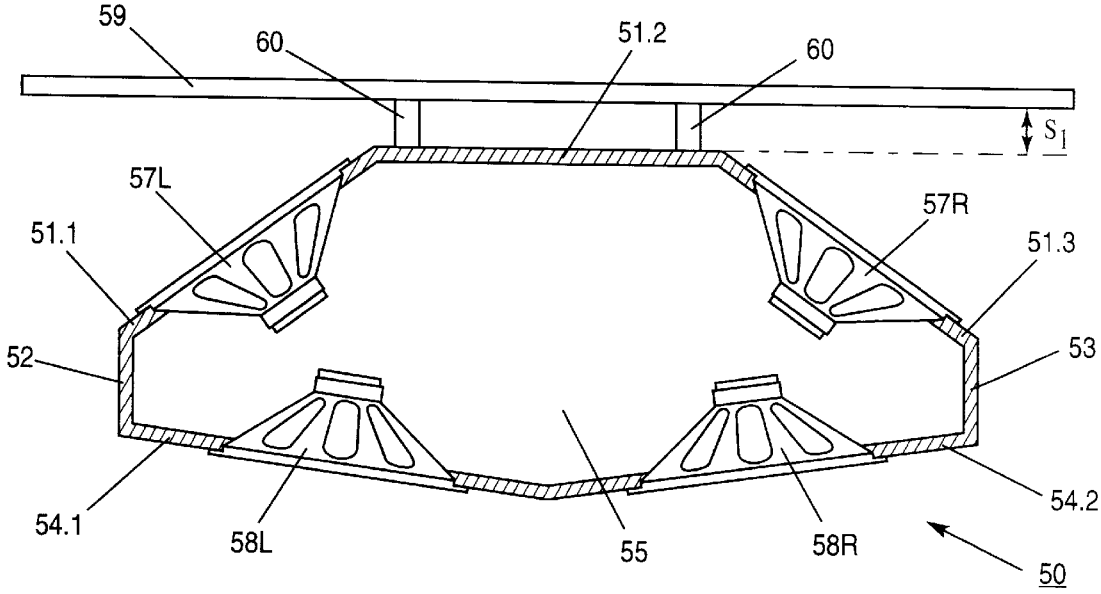

The invention will now be explained with the sole aim of making the invention better understood, with reference to some non-limitative examples of embodiments shown in the drawing, in which:

FIG. 1 is a schematic perspective view of a stereo installation according to the invention, FIG. 2 is a cross-section of the loudspeaker system according to FIG. 1, FIG. 3 is a cross-section similar to that in FIG. 2, of a second embodiment of a loudspeaker system according to the invention, FIG. 4 is another similar cross-section of a third embodiment, FIG. 5 is a schematic perspective view of a further stereo installation according to the invention having an integral reflector, and FIG. 6 is a cross section of the loudspeaker system of FIG. 5.

FIGS. 1 and 2 show a stereo loudspeaker system 1 comprising a unitary enclosure 2. In the following, the stereo loudspeaker system 1 will be referred to as the speaker box or simply, the box. The enclosure 2 comprises a rear wall 3. The enclosure can in a conventional fashion be made up of walls composed of a suitable ligneous material or of another suitable material, and may be provided on its inside with sound-insulating materials, not shown in, the drawing. The different walls are suitably connected to each other in an airtight fashion to form a firm, box-shaped entity. In the embodiment shown, the speaker box has been placed on a pedestal 9, comprising a tubular support to as well as a base 11. The loudspeaker system stands on a floor 12 of a listening room by means of the pedestal 9, the rear wall 3 of the enclosure being spaced a distance 5 from a wall 13 of the listening room. In the embodiment shown in FIGS. 1 and 2, the rear wall 3 consists of three separate panels indicated as 3.1, 3.2 and 3.3. The panel 3.2 is parallel to the wall 13 of the listening room, while the panels 3.1 and 3.3 are oriented at an angle $\alpha$ to each other. See FIG. 2. The arrangement is embodied in such a way, that the separate panels belonging to the rear wall 3 are disposed symmetrically relative to a central axis 14 which is parallel to the floor 12. In the panels 3.1 and 3.3, respectively, of the rear wail 3, woofers 15L and 15R are mounted. These woofers are completely similar, the letters L and R being abbreviations of "Left" and "Right", respectively. This characterization relates to the fact that the loudspeaker 15L can be connected to a left stereo channel and the loudspeaker 15R can be connected to a right stereo channel of a stereo amplifier not shown in the drawing. All electric connecting wires and any electric and electronic components present, have been omitted from the drawing for the sake of clarity, but can be selected entirely according to the known art and may for example comprise suitable frequency separating filters in each of the stereo channels. In the continuation of the description the letters L and R will only be used with respect to loudspeakers to indicate that there can be connected to the left and the right stereo channel, respectively.

In addition to the woofers 15L and 15R, the speaker box 1 comprises tour other loudspeakers 16L and 16 R, and 17L and 17R, respectively. All loudspeakers 15L-R, 16L-R and 17L-R are located substantially in a single loudspeaker plane which is parallel to the floor 12 and which comprises the axis 14. This plane is located at a height H of approximately 100 cm, but can also be located at a different height, if desired.

In the rear wall panel 3.2 of the rear wall 3 which is parallel to the wall 13 of the listening room, two identical bass reflex pipes 18L and 18R, respectively, are present, which are disposed symmetrically relative to the axis 14. It has been found to be very important that these bass reflex pipes are disposed between the woofers 15L and 15R which are also arranged symmetrically.

The bass reflex pipes 18L, 18R are also located in the plane through the axis 14 parallel to the floor 12.

It has been established by experiment that the angle $\alpha$ between the woofers 15L and 15R is preferably within the range of 55 to 70 degrees. Preferably, this angle is about 62 degrees.

The loudspeakers 15L, 16L and 17L can be connected, to the left stereo channel of a stereo amplifier, which is not shown in the drawing. The other half of the six loudspeakers present, comprising the loudspeakers 15R, 16R en 17R, can be connected to the right stereo channel. In the front wall 4 of the enclosure 2 of the speaker box, a midrange loudspeaker (squawker) 16L that can be connected to the left stereo channel, and a high-frequency loudspeaker (tweeter) 17L that can be connected to the left stereo channel, as well as a squawker 16R that can be connected to the right stereo channel, and a tweeter 17L that can be connected to the right stereo channel, are disposed. According to the invention, the two tweeters 17L, 17R are disposed between the two squawkers 16L, 16R. According to another particular aspect, the tweeter 17R that can be connected to the right stereo channel is disposed between the squawker 16L and the tweeter 17R that can both be connected to the left stereo channel. The tweeter 17L that can be connected tot the left stereo channel is in turn disposed between the squawker 16R an the tweeter 17R which can both be connected to the right stereo channel. Hence, the two tweeters are an exception to the general rule that, in the speaker box 1 according to FIGS. 1 and 2, the loudspeakers that can he connected to the left stereo channel are located in the left part of the speaker box and that the loudspeakers that can be connected to the right stereo channel are located in the right part. It has been found that by means of this special arrangement an improved stereo impression in combination with a reduced sensitivity to the position of the listener in the listening room relative to the speaker box can be achieved.

The front wall 4 of the enclosure 2 consists of four panels, indicated as 4.1, 4.2, 4.3 and 4.4 respectively. The squawkers 16L and 16R are respectively disposed in the front wall panels 4.1 and 4.4, while the tweeters 17L sad 17R are respectively disposed in the front wall panels 4.3 and 4.2.

According to a particular aspect of the embodiment shown in FIGS. 1 and 2, the front wall panels 4.1 and 4.2, and consequently the squawkers 16L and 16R, are oriented at an angle β relative to each other. This angle is larger than the angel α between the woofers 15L and 15R and is for example about 150 degrees. The wall panels 4.1 and 4.3 are approximately parallel to each other so that the two loudspeakers 16L and 17L that are connected to the left stereo channel are also disposed approximately parallel to each other. The two loudspeakers 16R and 17R that can be connected to the right stereo channel are also disposed in parallel wall panels, viz. 4.2 and 4.4 respectively. The resulting arrangement is again symmetrical with respect to the central axis 14. These special measures also contribute to the overall quality of the stereo reproduction.

The acoustic space enclosed within the walls of the speaker box is shared by the woofers 15L and 15R, in addition to which said acoustic space can contain one or more conductors made of a rigid material for the purpose of bass reelection, such as, for example, the conductor 19 shown in FIG. 2. The shape and position of such conductors can be determined on the basis of calculations and/or tests.

The openings in the enclosure in which the loudspeakers are disposed can be covered in a conventional fashion by a substantially sound-transparent grid or cloth in order to protect the loudspeakers and to improve the external appearance of the speaker box. For the sake of convenience and clarity such provisions are not shown in the drawing, but these can be of each desired and suitable known type. The pedestal 9 shown in FIG. 1 can be embodied in a completely different way and can be chosen on the basis of aesthetic and practical considerations, it desired. The pedestal should of course not have any negative effect on the performances of the speaker box, and should in particular not cause any resonances or transmission or vibrations to the floor 12. There are, however, suitable prior art solutions for this, which are nor associated with the invention and will not be described further here. It is of course also possible to use a pedestal which is part of the enclosure of the speaker box, instead of a separate pedestal. Instead of using a pedestal, the speaker box could also be attached to the wall 13.

The embodiments of FIGS. 3 and 4 are in principle little different from the embodiment shown in FIGS. 1 and 2, but are suitable for a higher outputs, the embodiment of FIG. 3 being suitable for a higher output than the embodiment shown in FIGS. 1 and 2, and the embodiment according to FIG. 4 being suitable for a higher output than the embodiment according to FIG. 3.

FIG. 3 shows a cross-section of a stereo loudspeaker system 20 having a rear wall 21 comprising the panels 21.1, 21.2 and 21.3. The system further comprises side walls 22 and 23, a front wall 24 comprising the panels 24.1, 24.2, 24.3 and 24.4, as well as a bottom wall 25. A top wall, which is not shown in the drawing, covers the speaker box at the top. In the rear wall, woofers 26L and 26R as well as bass reflex pipes 27L and 27R arc disposed. In the front wall, squawkers 28L and 28K as well as tweeters 29L and 29R are disposed. Unlike the speaker box according to FIGS. 1 and 2, the rear wall 21 of the speaker box according to FIG. 3, more in particular the rear wall panels 21.1 and 21.3 respectively, comprise two bass reflex pipes indicated as 30L and 30R respectively. As shown in FIG. 3, these bass reflex pipes are not located between the woofers 26L and 26R, but adjacently and in the outside of these. The indicated angles α and β are substantially equal to those shown in FIG. 2.

Even larger outputs can be reproduced using the speaker box 30 according to FIG. 4. This speaker box has a rear wall 31, side walls 32 and 33, a front wall 34, as well as a bottom mall 35. A top wall is not shown in the figure, but the box is closed in the usual way at the top by a top wall which is parallel to the bottom wall 35. The rear wall consists of three panels, 31.1, 31.2 and 31.3 respectively. The front wall 33 consists of the panels 34.1 to 34.6. The two woofers, 36L and 36R respectively, are disposed in outwardly extending parts 37.1 and 37.2 respectively, as a result of which the rear wall panels 31.1 and 31.3 respectively are disposed slightly outwards with respect to the rear wall panel 31.2. The main reason for this is that the volume of the speaker box can be enlarged in this way. The part 31.2 of the rear wall comprises two bass reflex pipes 38L and 38R respectively. Between these bass reflex pipes and the two woofers, two other bass reflex pipes 39L and 36R are disposed respectively in the rear wall panels 31.1 and 31.3, next to the woofers 36L and 36R respectively. The front wall 34 comprises two squawkers 40L and 40R as well as two tweeters 41L and 41R. The relative positioning of these four speakers is again similar to that shown in FIGS. 1–3, except that the angle β between the two squawkers 40L and 40R is not located outside the speaker box but inside thereof in this embodiment. This has been found to result in a better sound reproduction in speaker boxes for greater outputs according to FIG. 4. In view of the slightly different shave of this speaker as well as the larger volume thereof, two conductors 42 are used in this embodiment for the purpose of reflection.

FIGS. 5 and 6 show a stereo loudspeaker system 50 having a rear wall 51 comprising the panels 51-1, 51-2 and 51-3. The system further comprises side walls 51 and 53, a front wall 54 comprising the panels 54-1 and 54-2, a bottom wall 55 and a top wall 56. The rear wall comprises the woofers 57L and 57R. The front wall comprises loudspeakers 58L and 58R with operate over the entire frequency range from the midrange frequencies up to the high frequencies. Unlike the other loudspeaker systems shown in the drawing, the loudspeaker system according to FIGS. 5 and 6 contains loudspeakers which are disposed in pairs at equal distances from an imaginary loudspeaker plane which is located approximately halfway lip the box. This embodiment does not comprise any bass reflex pipes, while the front wall 54 only comprises two panels. Another characteristic feature of this embodiment is that the reflecting wall consists of a reflector 59 which is connected to the enclosure. This reflector is connected to the enclosure in an inseparable fashion by means of a number of spacer members 60. These members can in principle be made of any material suitable for carrying the reflector 59 and may possess vibration-insulating properties, if desired. As shown in the drawing, the reflecting wall or reflector 59 consists of a flat board of dimensions and of a material suitable for the intended purpose. The distance S1 between the rear wall 51 of the enclosure of the speaker box and the reflector 59 is such that an optimum sound quality is achieved. This distance can for example be determined by experiment. In the embodiment shown, the loudspeaker system is again mounted on a pedestal 61 similar to the pedestal of the loudspeaker system of FIG. 1. said pedestal consisting of a tubular support 62 as well as a base 63.

Although the above description explains the invention with reference to a drawing of four different embodiments of the invention, the invention is by no means limited to these, but on the contrary comprises all the embodiments possible within the scope indicated by the claims. Many variations with respect to the shape of the enclosure of the speaker box, the materials used, are well as the relative positioning of the loudspeakers and bass reflex pipes used, are conceivable.

The main thing is that there is an even number of woofers and other loudspeakers, that these are located in a unitary enclosure and that these are disposed approximately next to each other in a single loudspeaker plane substantially at a certain height, preferably a height adapted to the normal listening position of the listener, or at least some of them, in pairs at equal distances from said loudspeaker plane. The system could for example be provided with second tweeters 17R and 17L, in such a way that each pair of corresponding tweeters would be located in a vertical plane at equal distances from the horizontal place through the axis 14. In combination with this, third tweeters 17R and 17L could be disposed in the position indicated in the drawing, if desired. Similar measures are also possible with the other loudspeakers and/or bass reflex pipes, if desired or if needed.

What is claimed is:

1. A stereo loudspeaker system comprising a unitary enclosure having a rear wall intended to be oriented towards a reflecting wall, a front wall positioned opposite thereof, side walls, a top wall and a bottom wall, said stereo loudspeaker system including an even number of low frequency types of loudspeakers, woofers, which are disposed symmetrically about a central loudspeaker plane in the rear well at an angle to each other, and in addition to the even number of symmetrically disposed woofers, the system includes an even number of other loudspeakers of other types, selected from one or more of high-frequency loudspeakers, tweeters, and midrange loudspeakers, squawkers, which are all located in said unitary enclosure, characterized in that an even number of symmetrically disposed bass reflex pipes are disposed in the rear wall between the woofer, and in that the bass reflex pipes are disposed in a configuration selected from the group consisting of all said bass reflex pipes in said central loudspeaker plane and all bass reflex pipes in said central loudspeaker plane except at least one pair at an equal distance from said central loudspeaker plane;

said other loudspeakers are disposed in the front wall of the enclosure; and all the loudspeakers present in the enclosure are disposed in a configuration selected from the group consisting of (1) each loudspeaker of a pair of equal type disposed symmetrically at an equal distance and angle from said central loudspeaker plane and (2) disposed in the central loudspeaker plane, each loudspeaker belonging to one of at least two channels.

2. A stereo loudspeaker system comprising a unitary enclosure having a rear wall intended to be oriented towards a reflecting wall, a front wall positioned opposite thereof, side walls, a top wall and a bottom wall, said stereo loudspeaker system including an even number of low frequency types of loudspeakers, woofers, which are disposed symmetrically about a central loudspeaker plane in the rear wall at an angle to each other, and in addition to the even number of symmetrically disposed woofers, the system includes an even number of other loudspeakers of other types, selected from one or more of tweeters, squawkers, and midrange speakers, which are all located in said unitary enclosure, characterized in that said other loudspeakers are disposed in the front wall of the enclosure, all the loudspeakers present in the enclosure are disposed in a configuration selected from the group consisting of (1) each loudspeaker of a pair of equal type disposed symmetrically at an equal distance and angle from said central loudspeaker and (2) disposed in the central loudspeaker plane, each loudspeaker belonging to one of at least two channels, one half of the loudspeakers present are connectable to a left stereo channel and another half are connectable to a right stereo channel of a stereo amplifier, the even number of other loudspeakers comprises a midrange loudspeaker, squawker, that is connectable to the left stereo channel, and a high-frequency loudspeaker, tweeter, that is connectable to the left stereo channel, as well as a squawker that is connectable to the right stereo channel, and a tweeter that is connectable to the right stereo channel, said other loudspeakers being disposed in the front wall of the enclosure, the two tweeters are disposed between the two squawkers, the tweeter for the right stereo channel is disposed between the squawker for the left stereo channel and the tweeter for the left stereo channel, and the tweeter for the left stereo channel is disposed between the squawker for the right stereo channel and the tweeter for the right stereo channel.

3. The stereo loudspeaker system according to claim 2, characterized in that squawkers are disposed in front wall panels which are oriented at an angle to each other, and in that tweeters are disposed in the front wall panel which is approximately parallel to the front wall panel in which the squawker of a corresponding stereo channel is disposed.

4. The stereo loudspeaker system according to claim 1, characterized in that the enclosure encloses an acoustic space which is at least shared by the woofers, in that one or more conductors made of rigid material are located within the acoustic space for the purpose of bass reflection.

5. A stereo loudspeaker system comprising a unitary enclosure having spaced generally parallel first and second main walls denominated as rear and front walls, a first perpendicular main wall denominated the rear wall, spaced from and generally parallel and opposite to the rear wall a second perpendicular main wall denominated the front wall, as well as perpendicular, spaced and opposedly positioned interconnecting perpendicular side walls between said rear wall and said front wall, said stereo loudspeaker system including an even number of low frequency loudspeakers denominated woofers which are disposed symmetrically in the rear wall at an angle to each other, and in addition to the even number of symmetrically disposed woofers, an even number of further loudspeakers of other types, selected from one or more of high-frequency loudspeakers, tweeters, and midrange loudspeakers, squawkers, which are all located in said unitary enclosure, all speakers being disposed in a symmetrical arrangement relative to a plane perpendicular to said main walls and generally midway between said side walls, characterized in that:

said woofers radiate sound from the rear of the enclosure only and in a direction away from the rear and the front wall;

said other loudspeakers are disposed in the front wall of the enclosure and radiate sound in a direction away from the front wall and the rear wall; and the loudspeakers present in the enclosure are disposed in a configuration selected from the group consisting of:

all loudspeakers disposed in a single central loudspeaker plane intermediate and parallel to the main walls; and all loudspeakers in said single central loudspeaker plane except for at least an even number of pairs of equal type disposed at equal distances from said central loudspeaker plane, each said pair being disposed in a common plane perpendicular to said central plane.

6. The stereo loudspeaker system according to claim 5, characterized in that:

an even number of symmetrically disposed bass reflex pipes are disposed in the rear wall between the woofers radiating sound from the rear of the enclosure only and in a direction away from the rear wall and the front wall; and the bass reflex pipes are disposed in a configuration selected from the group consisting of all said bass reflex pipes in said single central loudspeaker plane and all bass reflex pipes in said single central loudspeaker plane except at least two pairs of equal type disposed at equal distance from said central loudspeaker plane, each said pair being disposed in a common plane perpendicular to said central plane.

7. The stereo loudspeaker system according to claim 5, characterized in that the angle between the woofers is within the range of 55 degrees to 70 degrees.

8. The stereo loudspeaker system according to claim 5, characterized in that:

one half of the loudspeakers present are connectable to a left stereo channel and another half are connectable to a right stereo channel of a stereo amplifier; and the even number of other loudspeakers comprise a midrange loudspeaker denominated a squawker connectable to the left stereo channel and a high-frequency loudspeaker denominated a tweeter connectable to the-left stereo channel, as well as a squawker connectable to the right stereo channel and a tweeter connectable to the right stereo channel, and wherein:

the two tweeters are disposed between the two squawkers;

the tweeter connectable to the right stereo channel is disposed between the squawker for the left stereo channel and the tweeter for the left stereo channel; and the tweeter connectable to the right stereo channel is disposed between the squawker for the left stereo channel and the tweeter for the left stereo channel.

9. The stereo loudspeaker system according to claim 8, characterized in that:

squawkers are disposed in front wall panels which are oriented at an angle to each other; and each tweeter is disposed in a front wall panel that is approximately parallel to the front wall panel in which the squawker of a corresponding stereo channel is disposed.

10. The stereo loudspeaker system according to claim 6, characterized in that:

the enclosure encloses an acoustic space which is at least shared by the woofers; and one or more conductors made of rigid material are located within the acoustic space for the purpose of bass reflection.

* * * * *